US008403059B2

(12) United States Patent
Hughes et al.

(10) Patent No.: US 8,403,059 B2
(45) Date of Patent: Mar. 26, 2013

(54) EXTERNAL JET PUMP FOR DUAL GRADIENT DRILLING

(75) Inventors: William James Hughes, Bixby, OK (US); Jack Everett Miller, Houston, TX (US)

(73) Assignee: Sunstone Technologies, LLC, Oklahama City, OK (US)

( * ) Notice: Subject to any disclaimer, the term of this patent is extended or adjusted under 35 U.S.C. 154(b) by 351 days.

(21) Appl. No.: 12/778,342

(22) Filed: May 12, 2010

(65) Prior Publication Data

US 2011/0278014 A1 Nov. 17, 2011

(51) Int. Cl.
*E21B 17/01* (2006.01)
*E21B 21/01* (2006.01)

(52) U.S. Cl. ..... 166/367; 166/344; 166/345; 166/358; 175/217

(58) Field of Classification Search ..... 166/367, 166/338, 339, 341, 344, 345, 351, 352, 358, 166/372, 378–381; 175/5, 207–209, 212, 175/217; 417/76, 151
See application file for complete search history.

(56) References Cited

U.S. PATENT DOCUMENTS

| | | | | |
|---|---|---|---|---|
| 270,488 | A | | 1/1883 | Saunders |
| 1,831,956 | A | | 11/1931 | Harrington |
| 2,201,270 | A | | 5/1940 | McIntyre |
| 2,207,199 | A | | 7/1940 | Hild |
| 2,234,454 | A | | 3/1941 | Riichter |
| 2,849,214 | A | | 8/1958 | Hall |
| 2,946,565 | A | | 7/1960 | Williams |
| 3,087,558 | A | | 4/1963 | Dougherty, Jr. |
| 3,208,539 | A | | 9/1965 | Henderson |
| 3,410,508 | A | | 11/1968 | Fisher |
| 3,603,409 | A | * | 9/1971 | Watkins ..... 175/7 |
| 3,638,721 | A | * | 2/1972 | Harrison ..... 166/351 |
| 3,815,673 | A | * | 6/1974 | Bruce et al. ..... 166/359 |
| 3,924,696 | A | | 12/1975 | Horlin et al. |
| 3,948,330 | A | | 4/1976 | Langford, Jr. |
| 4,022,285 | A | | 5/1977 | Frank |
| 4,046,191 | A | * | 9/1977 | Neath ..... 166/352 |
| 4,073,352 | A | | 2/1978 | Underwood |
| 4,091,881 | A | * | 5/1978 | Maus ..... 175/7 |
| 4,095,656 | A | | 6/1978 | French |
| 4,099,583 | A | * | 7/1978 | Maus ..... 175/7 |
| 4,185,856 | A | | 1/1980 | McCaskill |
| 4,239,087 | A | | 12/1980 | Castel et al. |
| 4,436,166 | A | | 3/1984 | Hayatdavoudi et al. |
| 4,448,255 | A | | 5/1984 | Shaffer et al. |
| 4,534,426 | A | | 8/1985 | Hooper |
| 4,567,954 | A | | 2/1986 | Voight, III et al. |
| 4,630,691 | A | | 12/1986 | Hooper |
| 4,687,066 | A | | 8/1987 | Evans |
| 4,744,730 | A | | 5/1988 | Roeder |
| 4,813,495 | A | * | 3/1989 | Leach ..... 175/6 |
| 4,949,785 | A | | 8/1990 | Beard et al. |
| 5,006,845 | A | * | 4/1991 | Calcar et al. ..... 367/81 |
| 5,062,479 | A | | 11/1991 | Bailey et al. |

(Continued)

FOREIGN PATENT DOCUMENTS

EP 1288434 A 5/2003

*Primary Examiner* — Matthew Buck
(74) *Attorney, Agent, or Firm* — Yee & Associates, P.C.

(57) ABSTRACT

An apparatus comprises a jet pump assembly affixed to a riser string and to a blowout preventer. The jet pump assembly comprises a conduit and a sealing assembly configured to accelerate a drilling fluid's return flow by a power fluid delivered by an umbilical connected to the conduit.

21 Claims, 11 Drawing Sheets

U.S. PATENT DOCUMENTS 5,178,215 A 1/1993 Yenulis et al.
5,273,108 A 12/1993 Piper
5,279,365 A 1/1994 Yenulis et al.
5,355,967 A 10/1994 Mueller et al.
5,372,190 A 12/1994 Coleman
5,456,326 A 10/1995 Raines
5,507,465 A 4/1996 Borle
5,562,171 A 10/1996 Besson et al.
5,771,984 A 6/1998 Potter et al.
5,775,443 A 7/1998 Lott
5,778,982 A 7/1998 Hauck et al.
5,836,404 A 11/1998 Trujillo et al.
5,848,643 A 12/1998 Carbaugh et al.
5,921,476 A 7/1999 Akin et al.
5,992,763 A 11/1999 Smith et al.
6,016,880 A 1/2000 Hall et al.
6,024,172 A 2/2000 Lee
6,109,348 A 8/2000 Caraway
6,129,152 A 10/2000 Hosie et al.
6,209,663 B1 4/2001 Hosie
6,227,547 B1 5/2001 Dietle et al.
6,230,824 B1 * 5/2001 Peterman et al. ..... 175/214
6,244,336 B1 6/2001 Kachich
6,276,455 B1 8/2001 Gonzalez
6,325,159 B1 * 12/2001 Peterman et al. ..... 175/7
6,328,107 B1 * 12/2001 Maus ..... 166/335
6,457,529 B2 * 10/2002 Calder et al. ..... 166/368
6,470,975 B1 10/2002 Bourgoyne et al.
6,497,290 B1 12/2002 Misselbrook et al.
6,520,253 B2 2/2003 Calder
6,530,437 B2 * 3/2003 Maurer et al. ..... 175/5
6,536,540 B2 * 3/2003 de Boer ..... 175/70
6,554,016 B2 4/2003 Kinder
6,571,873 B2 * 6/2003 Maus ..... 166/250.07
6,626,245 B1 9/2003 Dallas
6,745,857 B2 * 6/2004 Gjedebo ..... 175/69
6,764,110 B2 7/2004 Russell
6,769,498 B2 8/2004 Hughes
6,802,379 B2 * 10/2004 Dawson et al. ..... 175/38
6,837,313 B2 * 1/2005 Hosie et al. ..... 175/25
6,843,331 B2 * 1/2005 de Boer ..... 175/70
6,877,571 B2 * 4/2005 Hughes et al. ..... 175/57
6,899,188 B2 5/2005 Hughes et al.
6,966,392 B2 * 11/2005 deBoer ..... 175/70
7,032,691 B2 * 4/2006 Humphreys ..... 175/62
7,090,036 B2 * 8/2006 deBoer ..... 175/70
7,165,610 B2 * 1/2007 Hopper ..... 166/84.4
7,270,185 B2 * 9/2007 Fontana et al. ..... 166/358
7,380,590 B2 6/2008 Hughes et al.
7,699,109 B2 * 4/2010 May et al. ..... 166/367
7,699,110 B2 * 4/2010 Anderson et al. ..... 166/368
7,762,357 B2 * 7/2010 deBoer ..... 175/66
7,992,654 B2 * 8/2011 deBoer ..... 175/66
7,992,655 B2 * 8/2011 deBoer ..... 175/70
8,033,335 B2 * 10/2011 Orbell et al. ..... 166/367
8,176,985 B2 * 5/2012 Humphreys ..... 166/358
2002/0104660 A1 8/2002 Nice et al.
2002/0170749 A1 11/2002 Hoyer et al.
2008/0296062 A1 * 12/2008 Horton et al. ..... 175/5
2009/0236144 A1 * 9/2009 Todd et al. ..... 175/5
2010/0006297 A1 * 1/2010 Stave ..... 166/335
2010/0175882 A1 * 7/2010 Bailey et al. ..... 166/335

* cited by examiner

EXTERNAL JET PUMP FOR DUAL GRADIENT DRILLING

BACKGROUND

1. Field

The present disclosure generally relates to offshore drilling services and methods, and more specifically to an apparatus and method for employing a jet pump in an underwater drilling environment.

2. Description of the Related Art

In order to produce fluids such as oil, gas, and water from subterranean rock formations, a well is drilled into the fluid-bearing zone. Most wells are generally drilled with a drilling rig, a drill bit, a drill pipe, and a pump for circulating fluid into and out of the hole that is being drilled. The drilling rig rotates and lowers the drill pipe and drill bit to penetrate the rock. Drilling fluid, sometimes referred to as drilling mud, is pumped down the drill pipe through the drill bit to cool and lubricate the action of the drill bit as it disaggregates the rock. In addition, the drilling fluid removes particles of rock, known as cuttings, generated by the rotational action of the drill bit. The cuttings become entrained in the column of drilling fluid as it returns to the surface for separation and reuse.

One method for artificially inducing lift to remove fluids from a well by using a jet pump and a power fluid. The use of jet pumps is common in production operations where drilling activity has stopped. In this case, the drill pipe and drill bit have been extracted and a jet pump is lowered into the well on the end of a tubing string. A surface pump delivers high-pressure power fluid down the tubing and through the nozzle, diffuser, and diffuser of the jet pump. The pressure of the power fluid is converted into kinetic energy by the nozzle, which produces a high velocity jet of fluid. The drilling and production fluids are drawn into the diffuser of the jet pump by the stream of high velocity power fluid flowing from the nozzle into the diffuser of the jet pump. The drilling and production fluids mix with the power fluid as they pass through the diffuser. As the fluids mix, the diffuser converts the high velocity mixed fluid back into a pressurized fluid. The pressured fluids have sufficient energy to flow to the surface through the annulus between the production casing and the tubing that carried the jet pump into the well.

In offshore drilling the drill bit is sent into rock formations beneath the sea. The drill bit is affixed to drill pipe that travels inside a riser string. The riser string is formed of a number of riser joints. The use of heavy weight drilling mud creates a high well bore pressure. The high well bore pressure is created when the drilling begins because of the column of drilling fluid in the drill pipe extending from the drilling platform to the seabed. The high well bore pressure creates a number of problems. The drilling fluid may flow outward from the drill hole and into the earth, causing a breakdown the formation. Furthermore, as discussed above, fluids in the reservoir may flow into the well bore while the well is being drilled or after the well is drilled and during production.

Accordingly, it would be advantageous to have a method and system which takes into account one or more of the issues discussed above as well as possibly other issues.

SUMMARY

According to one embodiment of the present invention, an apparatus may comprise a riser joint, a conduit located outside the riser joint and configured for fluid communication with the riser joint at a first entry point and a second entry point, and a port on the conduit for receiving an umbilical. A sealing assembly may be engaged in an inner wall of the riser joint. A flexible seal carrier having a first end and a second end may be configured to surround a drill pipe and to engage a running sub on the drill pipe. A flexible seal may be affixed to the first end and configured to surround the drill pipe. A power fluid may be injected into the conduit through the umbilical so that the riser joint and the conduit form a jet pump. The drill pipe may pass through the riser joint and the sealing assembly.

In another embodiment, a method may comprise providing a riser joint configured to engage a sealing assembly at a first recess in an inner wall of the riser joint, locating a conduit outside the riser joint, configuring the conduit for fluid communication with the riser joint at a first entry point above the recess and a second entry point below the recess, and providing a port on the conduit configured to receive an umbilical so that when the sealing assembly engages the first recess and a power fluid is injected into the conduit through the umbilical the riser joint and the conduit form a jet pump.

In another embodiment, a method may comprise affixing a jet pump assembly to a riser string, the jet pump assembly comprising a sealing assembly and a conduit configured for fluid communication with the jet pump assembly at a first entry point above the sealing assembly and a second entry point below the sealing assembly, passing a drill pipe through the riser string and the sealing assembly, forming a seal around the drill pipe with a flexible seal included in the sealing assembly, affixing an umbilical to a port on the conduit for receiving an umbilical, injecting a power fluid into the conduit through the umbilical, and forcing a drilling fluid up the riser string by an action of the jet pump assembly.

In an embodiment, a system may comprise a jet pump assembly affixed to a riser string and to a blowout preventer. The jet pump assembly may comprise a conduit and a sealing assembly configured to accelerate a drilling fluid's return flow by a power fluid delivered by an umbilical connected to the conduit.

BRIEF DESCRIPTION OF THE SEVERAL VIEWS OF THE DRAWINGS

The novel features believed characteristic of the illustrative embodiments are set forth in the appended claims. The illustrative embodiments, however, as well as a preferred mode of use, further objectives and advantages thereof, will best be understood by reference to the following detailed description of an illustrative embodiment of the present invention when read in conjunction with the accompanying drawings, wherein:

DETAILED DESCRIPTION

Figure 1:
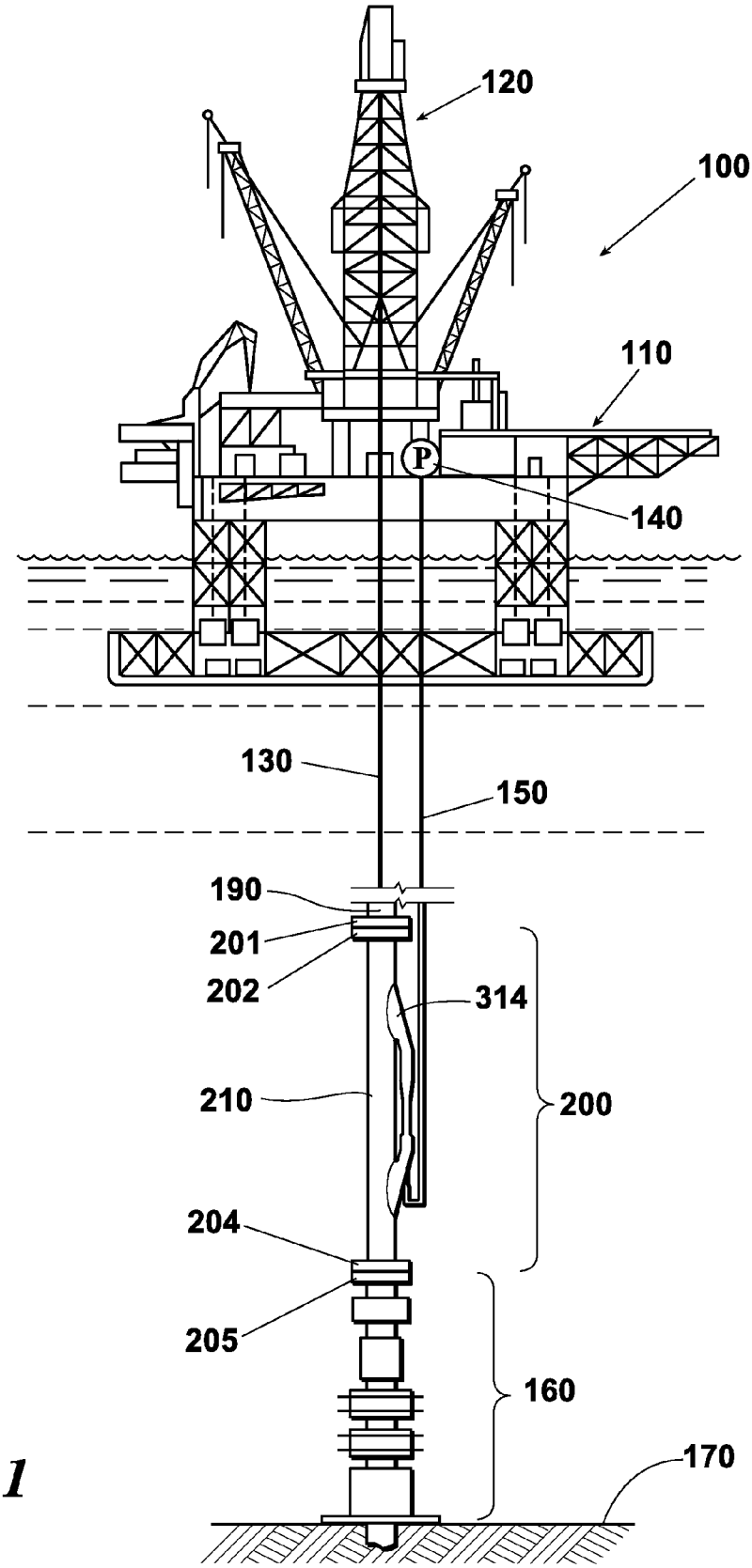
FIG. 1 is an illustration of a drilling system in accordance with an illustrative embodiment.

With reference now to the figures and particularly with reference to FIG. 1, an illustration of a drilling system is depicted in accordance with an illustrative embodiment. In this illustrative example, hydrocarbon drilling system A 100 includes platform 110, derrick 120, and riser string 130. In the example, platform 110 is an offshore drilling platform. Persons skilled in the art recognize and take into account that drilling into a formation beneath water may be conducted by a number of platforms, including, without limitation, offshore drilling platforms, drilling ships, submersible drilling platforms configured for positioning on the ocean bed, and inshore drilling platforms. Offshore drilling platforms, drilling ships, and submersible drilling platforms may be configured for positioning above and drilling into a bed of an ocean or a sea. Inshore drilling platforms may be configured for positioning above and drilling into a bed of an ocean inlet, a lake or a river.

The advantageous embodiments recognize and take into account that riser strings such as riser string 130 may be constructed as an assembly of a number of riser joints. An assembly of a number of riser joints such as riser string 130 may be formed by coupling one riser joint to another. Each riser joint may have an upper end flange and a lower end flange. The upper end flange of one riser joint may be bolted to the lower end flange of another riser joint. A seal may be located between the upper end flange of one riser joint and the lower end flange of another section. Any number of riser joints such as riser joint 190 may be coupled together to form a riser string such as riser string 130. As used herein, "a number" means "one or more". The advantageous embodiments recognize and take into account that riser joints are typically in a range of forty to seventy-five feet long. A riser joint may include external syntactic foam buoyancy. The external syntactic foam buoyancy reduces the weight in the water of the riser joint to which it is affixed, and the external syntactic foam buoyancy of each riser joint reduces the weight in the water of the riser string formed by the number of riser joints.

Riser string 130 extends from platform 110 to riser joint 190. Blowout preventer stack 160 affixed to seabed 170. Jet pump assembly 200 is affixed to blowout preventer stack 160. Jet pump assembly comprises jet pump riser joint 210, jet pump riser joint upper flange 202, jet pump riser joint lower flange 204, and umbilical A 150. Jet pump assembly further comprises sealing assembly A 230. Sealing assembly A 230 is discussed in detail in FIGS. 2-7 below. Jet pump riser joint upper flange 202 affixes to riser joint 190 at riser joint lower flange 201. Jet pump riser joint lower flange 204 affixes to blowout preventer stack flange 205. Umbilical A 150 is connected to pump 140 on platform 110 and to jet pump riser joint 210.

Figure 6:
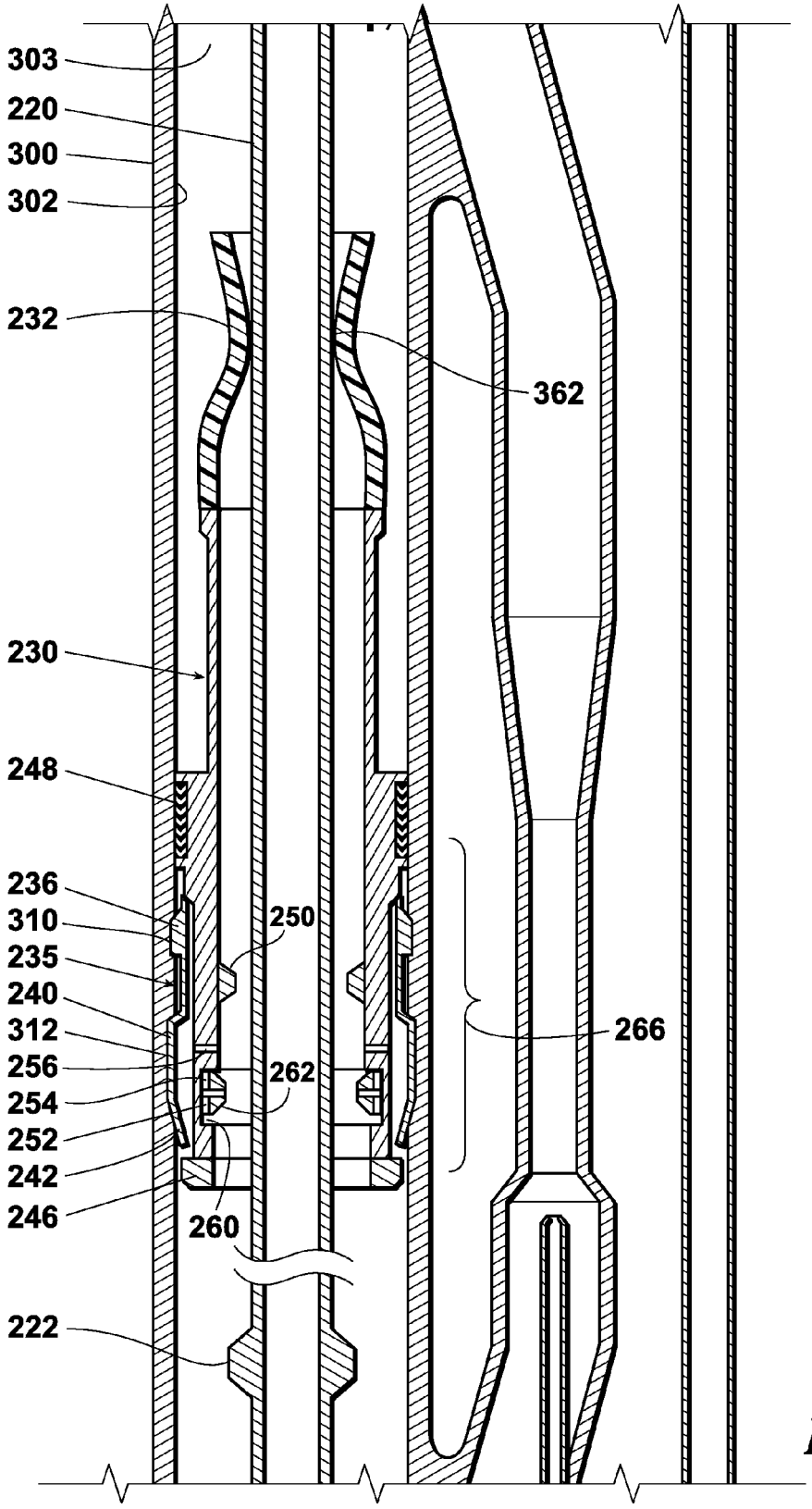
FIG. 6 is a detailed illustration of the sealing assembly affixed to the riser joint of FIG. 5 in accordance with an illustrative embodiment.
Figure 7:
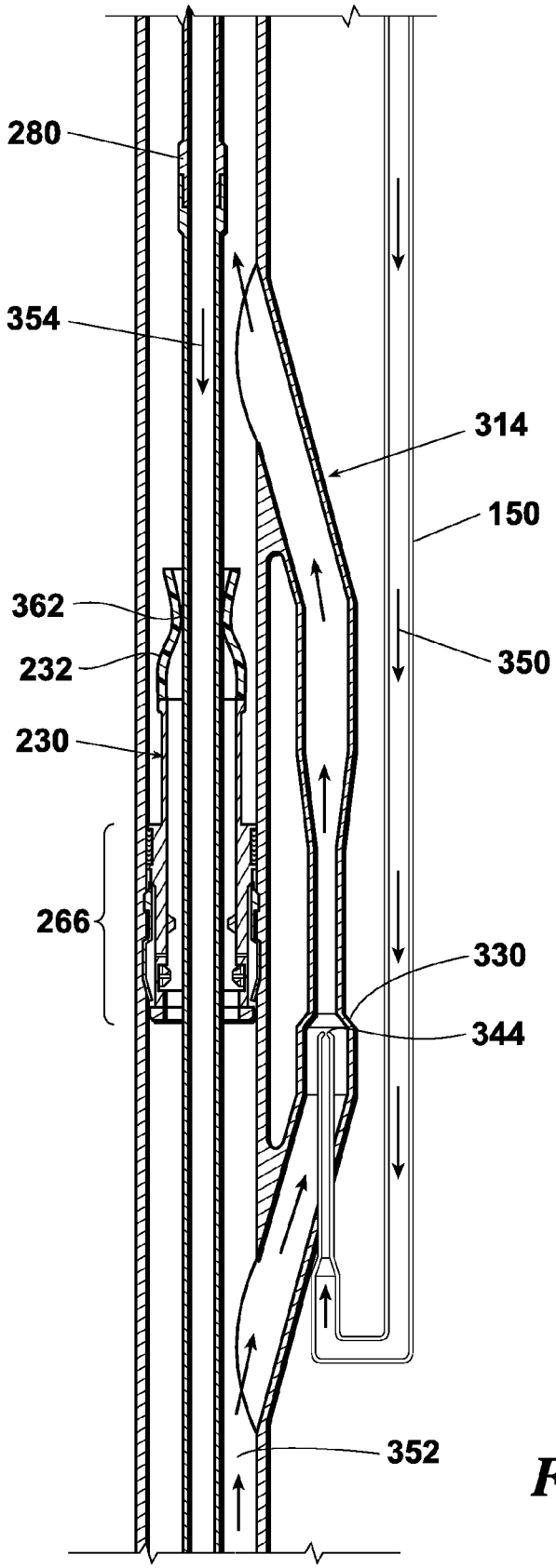
FIG. 7 is an illustration of fluid flow in a jet pump formed by the sealing assembly affixed to the jet pump riser joint and a power fluid introduced into the conduit in accordance with an illustrative embodiment.
Figure 8:
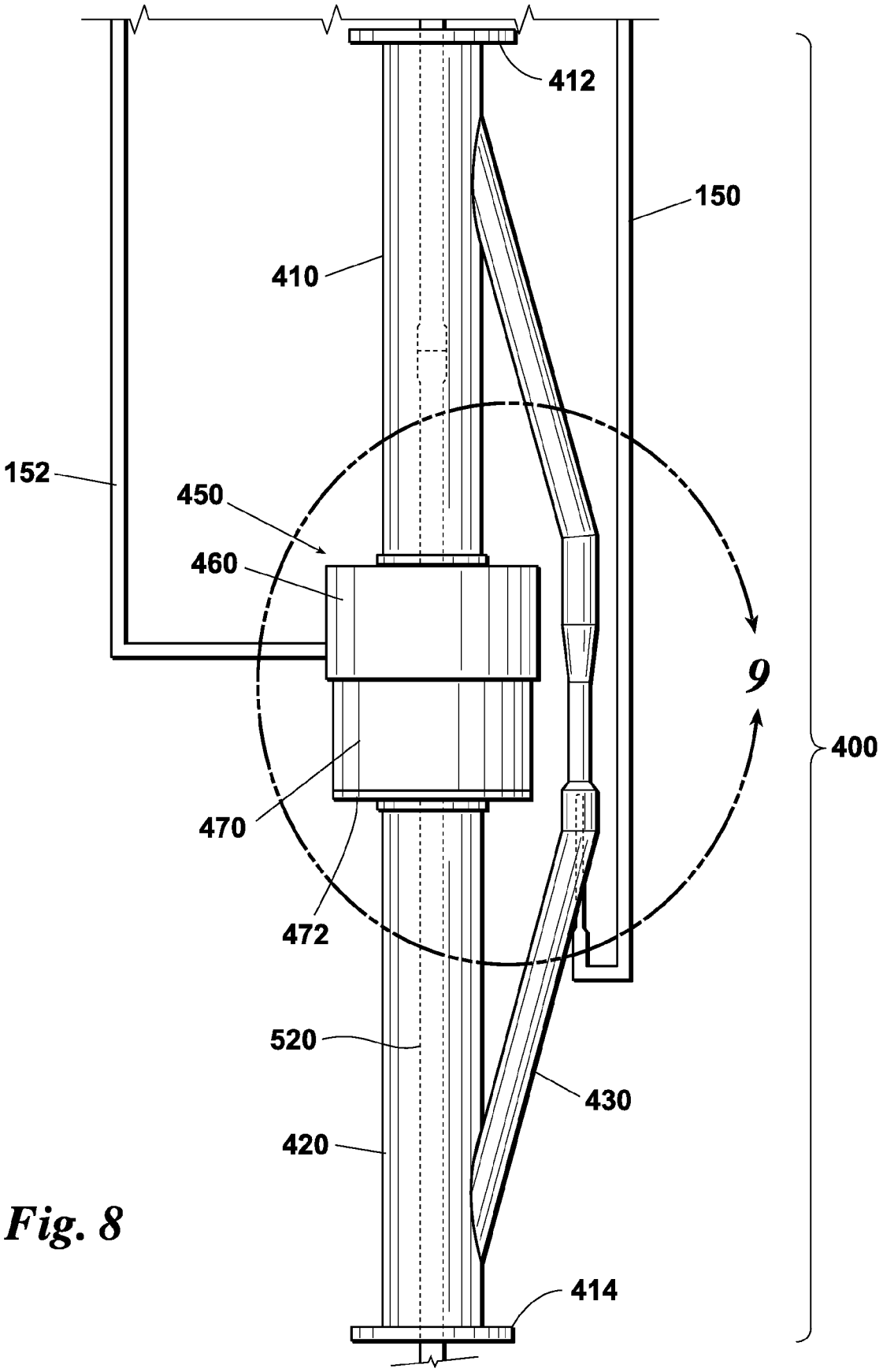
FIG. 8 is an illustration of an alternate jet pump assembly in accordance with an illustrative embodiment.
Figure 9:
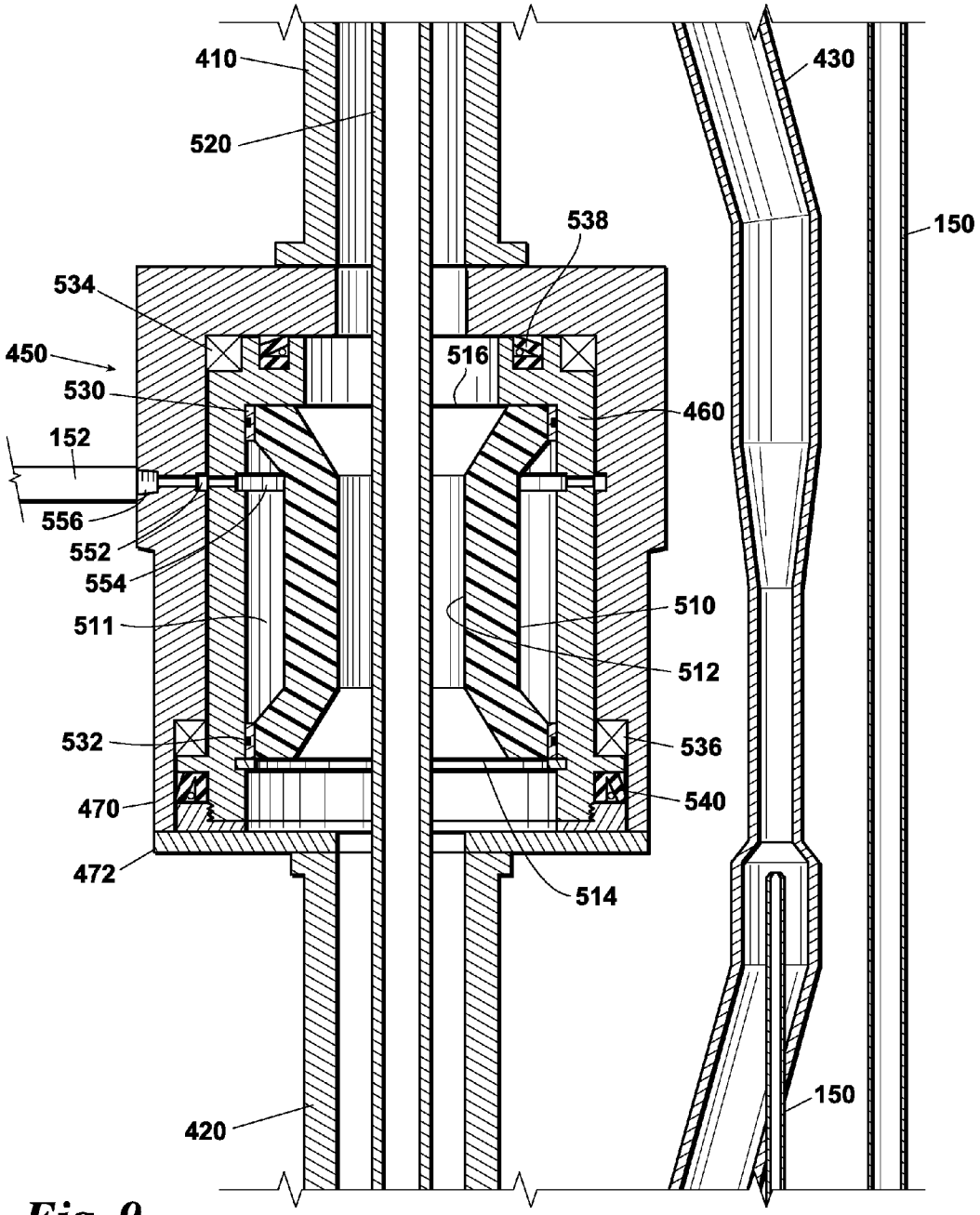
FIG. 9 is a detailed illustration of the alternate jet pump assembly of FIG. 8 in accordance with an illustrative embodiment.

The advantageous embodiments recognize and take into account that in deepwater drilling, the drill pipe such as drill pipe A 220 in FIG. 2 through FIG. 7 and drill pipe B 520 in FIG. 8 and FIG. 9 is approximately five and one-half to six and five-eighths inches in outside diameter and a riser joint such as riser joint 190 or jet pump riser joint 210 is approximately nineteen to nineteen and one-half inches in inside diameter to allow passage of a drill bit or other tools with an approximate eighteen and three-quarters inch diameter. The outside diameter of the riser joint is approximately twenty one inches. In an advantageous embodiment, the drill pipe and the riser string form only one annulus for moving fluid to the surface.

The advantageous embodiments recognize and take into account that external pipes may run from platform 110 alongside riser string 130 in order to control a number of devices that may be attached to riser string 130 or that may be attached to a number of subsea controls for a number of devices located near the seabed 170. In an embodiment, such external pipes may be approximately five inches in diameter. In an embodiment, such external pipes may contain a number of control lines that may be connected to the number of subsea controls. In an example, a subsea control may be a blowout preventer such as blowout preventer stack 160 in FIG. 1. In addition, external flexible hoses such as umbilical A 150 may run from platform 110 to jet pump assembly 200.

The advantageous embodiments recognize and take into account that drilling fluid and production fluid may be circulated by pumping drilling fluid down the drill pipe and out the drill bit and back up to the surface through an annulus between the outside of the drill pipe and the inside of the riser string. A power fluid may be introduced into the annulus by a jet pump. In an example, a power fluid may be sea water, drilling fluid, or oil.

A jet pump that introduces a power fluid into the annulus may be used to lower the hydrostatic weight, by one or two pounds per gallon, when pumping the return fluid back to surface. The decrease of one or two pounds per gallon of hydrostatic weight in the wellbore improves drilling performance. In an example, drilling performance may be improved because the reduction in hydrostatic weight prevents damage to a well bore caused by the hydrostatic head. The process of reducing hydrostatic pressure through manipulation of the pressure profile in the annulus is known as "dual gradient" drilling. The advantageous embodiments recognize and take into account that when a jet pump introduces a power fluid into the annulus to increase the return flow of the drilling mud to the surface, the overall hydrostatic weight in the wellbore is reduced.

Figure 2:
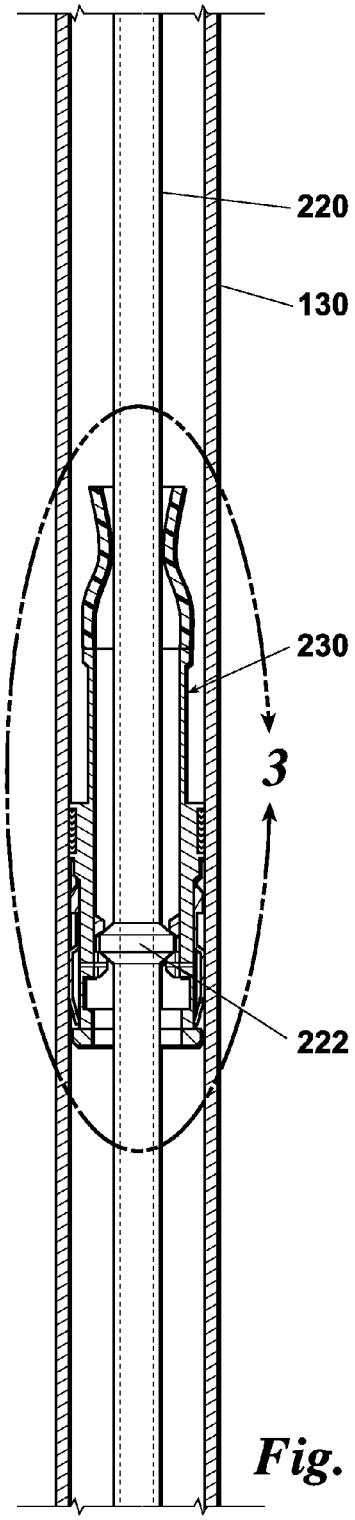
FIG. 2 is an illustration of riser joint with a sealing assembly affixed to a drill pipe and slidingly engaged in a riser string in accordance with an illustrative embodiment.

FIG. 2 is an illustration of riser joint with a sealing assembly affixed to a drill pipe and slidingly engaged in a riser string in accordance with an illustrative embodiment. Referring to FIG. 2, sealing assembly A 230 may be affixed to running sub 222 of drill pipe A 220 and is shown configured for movement by sliding up and down within riser string 130.

Figure 3:
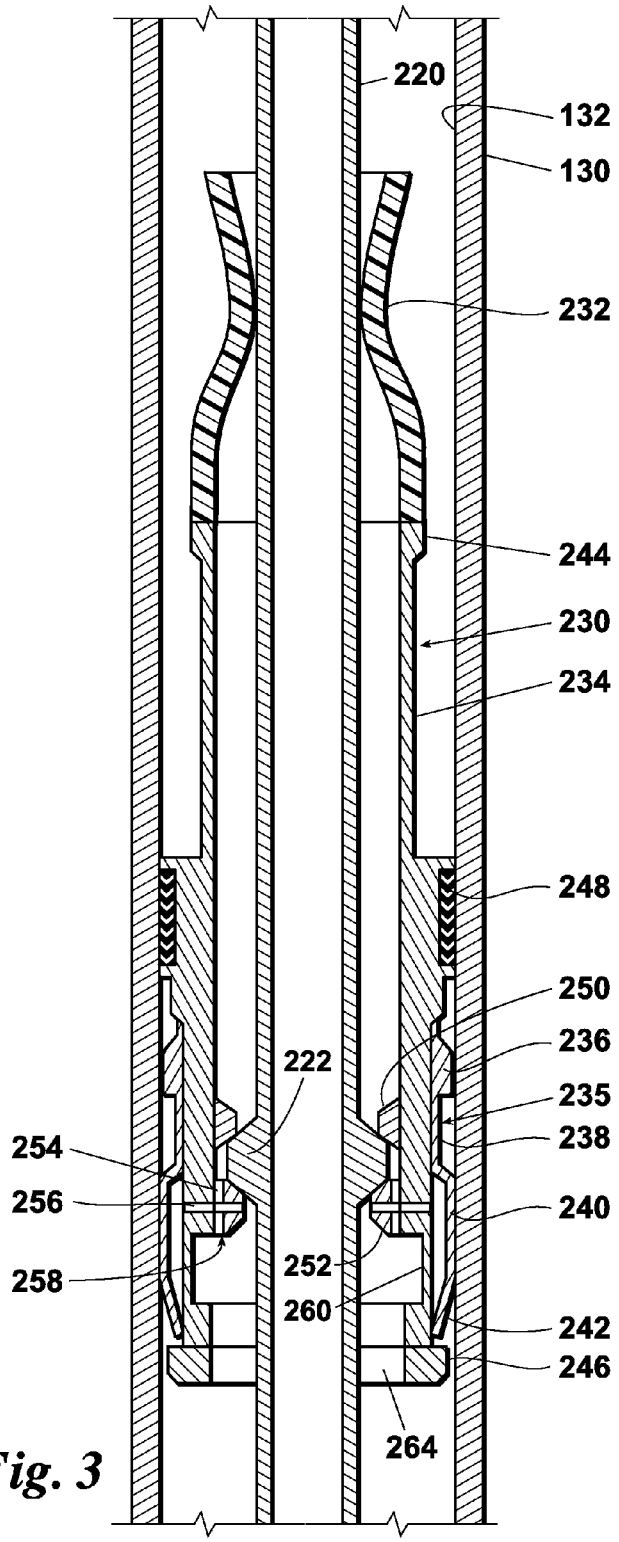
FIG. 3 is a detailed illustration of the riser joint with a sealing assembly affixed to the drill pipe and slidingly engaged in the riser string of FIG. 2 in accordance with an illustrative embodiment.

FIG. 3 is a detailed illustration of the riser joint with a sealing assembly affixed to the drill pipe and slidingly engaged in the riser string of FIG. 2 in accordance with an illustrative embodiment. Referring to FIG. 3, sealing assembly A 230 comprises flexible seal A 232, flexible seal A carrier 234, latch assembly 235, static seal 248, first lug 250, second lug 252, flexible seal A carrier transition 244, and flexible seal A carrier guide 246. Flexible seal A 232 may be affixed to flexible seal A carrier 234 at flexible seal A carrier transition 244. Sealing assembly A 230 may be configured for sliding movement within riser string 130 by flexible seal A carrier 234. Flexible seal A carrier 234 may engage running sub 222 of drill pipe A 220 with first lug 250 and second lug 252. Flexible seal A carrier 234 may slide within riser string 130 and may contact riser string inner wall 132 by static seal 248. In an embodiment, latch assembly 235 may slide along riser string inner wall 132.

Latch assembly 235 may have latch first key 236, latch recess 238, latch second key 240, and latch guide 242. Latch first key 236 and latch second key 240 may exert outward pressure against riser string inner wall 132 while sliding within riser string inner wall 132. Latch assembly 235 may affix to an inner wall of a riser joint of jet pump riser joint 300 after travelling down riser string 130 to jet pump riser joint 300. Jet pump riser joint 300 is discussed in FIGS. 4 through 7. Flexible seal A carrier 234 may have flexible seal A carrier opening 264. Second lug 252 may have vertical shear line 254 and shear pin 256. Second lug 252 may have second lug first position 258, and may move to second lug second position 262 in second lug second position recess 260.

Figure 4:
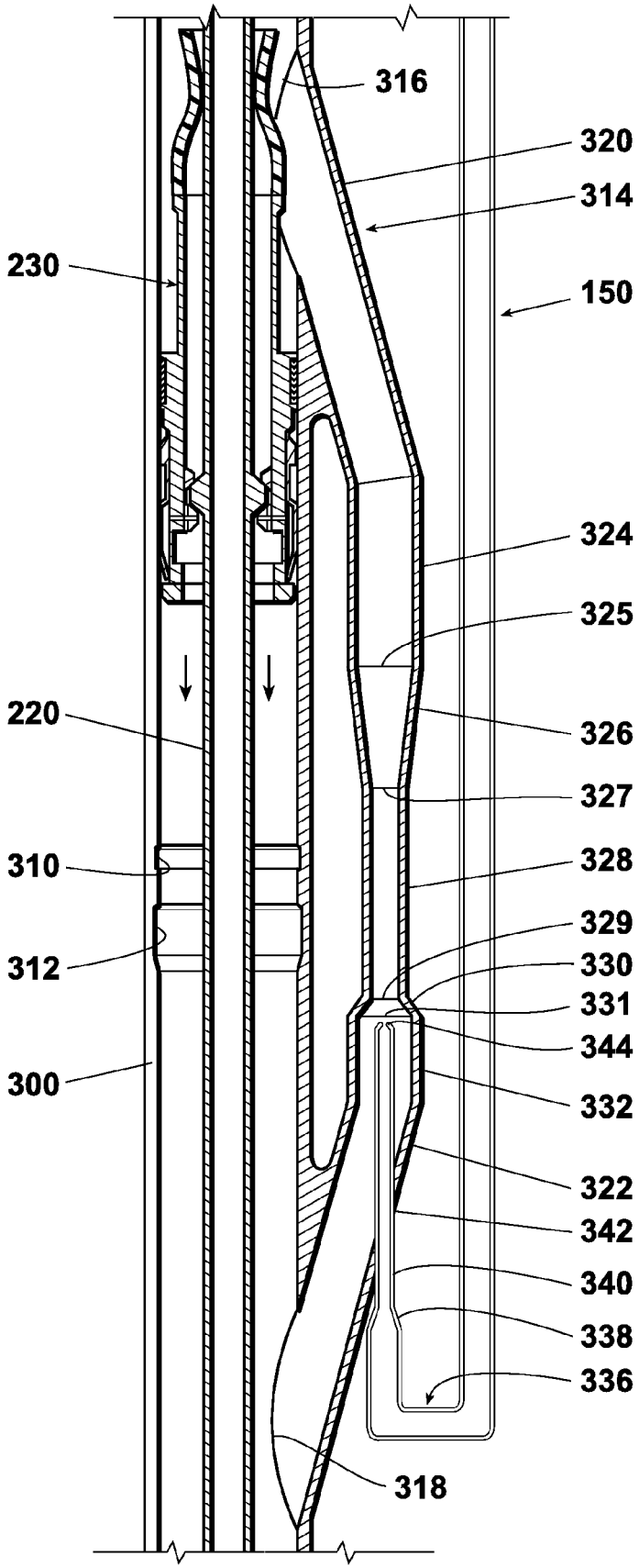
FIG. 4 is an illustration of a riser joint with a sealing assembly moving downward in a jet pump riser joint in accordance with an illustrative embodiment.

FIG. 4 is an illustration of a riser joint with sealing assembly A 230 moving downward in a jet pump riser joint in accordance with an illustrative embodiment. In the example of FIG. 4, sealing assembly A 230 may be affixed to drill pipe A 220 at running sub 222 and, in an example, may have moved into jet pump riser joint 300. Jet pump riser joint 300 may have riser joint first recess 310 in riser joint inner wall 302 and may have riser joint second recess 312 in riser joint inner wall 302. Conduit A 314 may be affixed to jet pump riser joint 300 at conduit exhaust joint 316 and at conduit intake joint 318. In an embodiment, conduit A 314 may be an integral part of jet pump riser joint 300. In another embodiment, conduit A 314 may be affixed to jet pump riser joint by modification of a riser joint. When a riser joint such as riser joint 190 in FIG. 1 is modified to be configured as a jet pump riser joint such as jet pump riser joint 300, the riser joint may be further configured to receive a sealing assembly such as sealing assembly A 230.

Conduit A 314 may have conduit exhaust angle section 320 extending downward and away from jet pump riser joint 300. Conduit exhaust angle section 320 joins conduit exhaust section 324. Conduit exhaust section 324 may be approximately parallel to riser joint 300. Conduit exhaust section 324 joins conduit diffuser section 326. Conduit diffuser section 326 may have a diffuser first diameter 325 where conduit diffuser section 326 joins conduit exhaust section 324. Conduit diffuser section 326 joins conduit mixing section 328. Conduit diffuser section 326 may have conduit second diffuser diameter 327 where conduit diffuser section 326 joins conduit mixing section 328. Conduit diffuser first diameter 325 may be approximately twice the length of diffuser second diameter 327.

Conduit A 314 may have conduit intake angle section 322 extending upward and away from riser joint 300. Conduit intake angle section 322 joins conduit entrance section 332. Conduit entrance section 332 joins conduit nozzle section 330. Conduit nozzle section 330 may have conduit nozzle first diameter 331 where conduit nozzle section 330 joins conduit entrance section 332. Conduit nozzle section 330 may have conduit nozzle second diameter 329 where conduit nozzle section 330 joins conduit mixing section 328. Conduit nozzle first diameter 331 may be greater than conduit nozzle second diameter 329.

Umbilical A 150 extends downward from platform 110 shown in FIG. 1. Umbilical A 150 may be affixed to riser string 130 in FIG. 1. Umbilical A 150 may be connected to a pump such as pump 140 on platform 110. Umbilical A 150 may have umbilical u-turn section 336, umbilical transition section 338, umbilical insert section 340, and umbilical nozzle 344. Umbilical insert section 340 enters conduit intake angle section 322 at umbilical junction 342. Umbilical insert section 340 may be sealingly engaged to conduit intake angle section 322 at umbilical junction 342.

Figure 5:
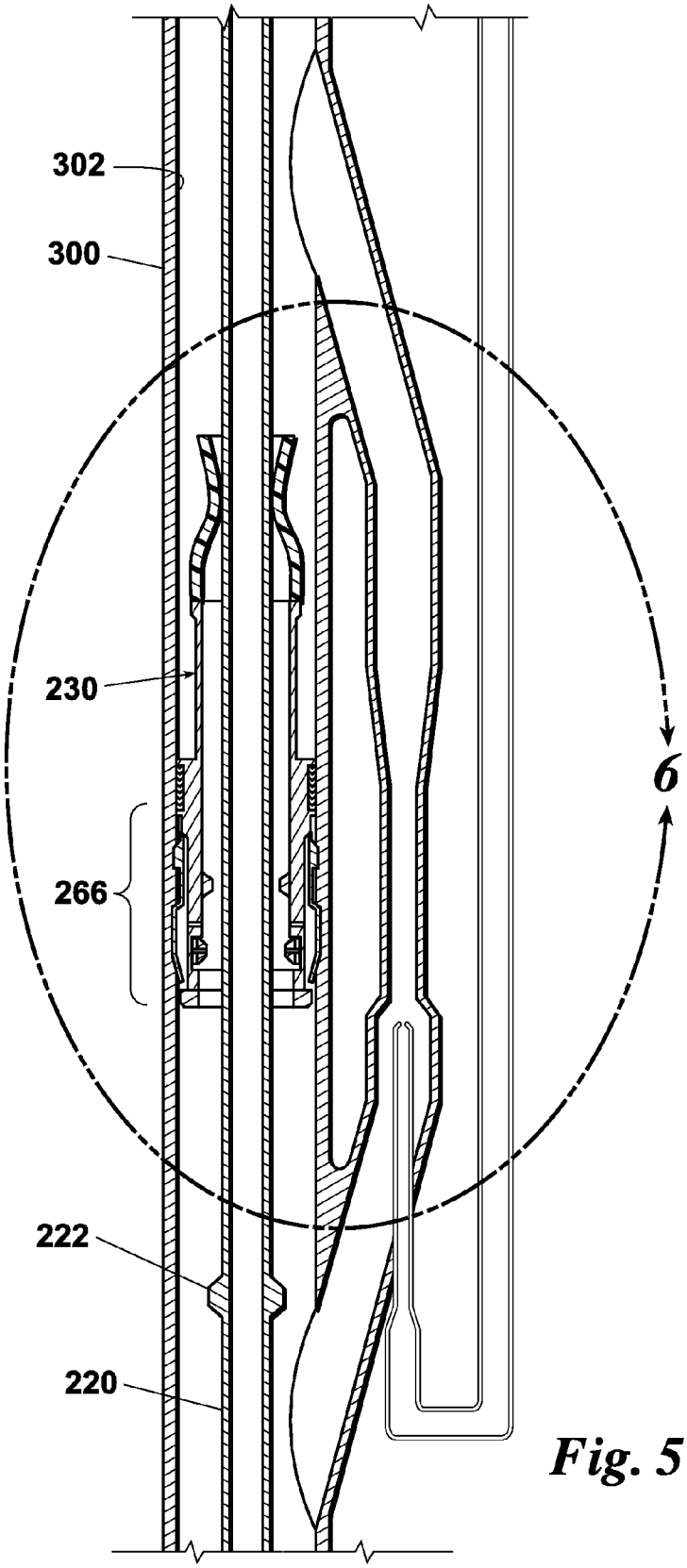
FIG. 5 is an illustration of a sealing assembly affixed to the riser joint in accordance with an illustrative embodiment.

FIG. 5 is an illustration of a sealing assembly affixed in riser joint in accordance with an illustrative embodiment. In the example of FIG. 5, sealing assembly A 230 may have been affixed to riser joint inner wall 302 of jet pump riser joint 300 at sealing assembly A locked position 266. Sealing assembly A 230 may have disengaged from running sub 222 of drill pipe A 220. Drill pipe A 220 may have passed through sealing assembly A 230 as shown by the position of running sub 222. Details of how sealing assembly may engage riser joint inner wall 302 and release running sub 222 of drill pipe A 220 are discussed further in the detailed view of FIG. 6.

FIG. 6 is a detailed illustration of the sealing assembly affixed to the riser joint of FIG. 5 in accordance with an illustrative embodiment. Referring to FIG. 6, sealing element A 230 may be affixed to riser joint inner wall 302 by latch assembly 235. In FIG. 4, sealing assembly A 230 may be pulled down within jet pump riser joint 300 by running sub 222 of drill pipe A 220. In FIG. 6, latch guide 242 may pass riser joint first recess 310 and riser joint second recess 312. Latch first key 236 may engage riser joint first recess 310 and latch second key 240 may engage riser joint second recess 312. Latch first key 236 and latch second key 240 may be biased outward so that they may snap into the corresponding recesses. Simultaneously with latch first key 236 and latch second key 240 engaging riser joint first recess 310 and riser joint second recess 312, downward movement of sealing element A 230 may be arrested. When downward movement of sealing element A 230 may be arrested, second lug 252 may break shear pin 256 and separate from flexible seal A carrier 234 along shear line 254.

In an embodiment, latch assembly 235 may be configured to break shear pin 256 when latch first key 236 and latch second key 240 engage riser joint first recess 310 and riser joint second recess 312. Persons skilled in the art recognize and take into account that a number of ways of releasing sealing element A 230 from running sub 222 of drill pipe A 220 are known to persons skilled in the art. In the example of FIG. 6, second lug 252 is shown in second lug second position 262 within second lug second position recess 260. In an embodiment, second lug 252 may have a spring, that is not shown in the figures, to pull second lug 252 into second lug second position recess 260 after being sheared from flexible seal A carrier 234. Persons skilled in the art are aware of a number of ways in which second lug 252 may be directed to a second position after shearing from flexible seal A carrier 234. For example, in an embodiment, second lug 252 may be a compressible ring backed by a spring in a concentric cavity so that when sufficient pressure is brought to bear, second lug 252 would retreat into the concentric cavity. Running sub 222 would be released, and a second lug second position such as second lug position 262 and a second lug second position recess such as second lug second position recess 260 would not be necessary.

Flexible seal A 232 may be slidingly engaged to drill pipe A 220 and drill pipe A 220 may slide though flexible seal A 232. Flexible seal A 232 is configured to allow passage of drill pipe tool joints, such as tool joint 280 in FIG. 7, to pass through flexible seal A 232 while maintaining a seal such as drill pipe seal 362 around drill pipe A 220. In addition to tool joints, such as tool joint 280, other variations in drill pipe diameter may be encountered. Such variations in drill pipe diameter may be known as upsets. Flexible seal A 232 may be configured to maintain a seal for upsets as well as for tool joints such as tool joint 280.

Pressure of fluid in annulus 303 pushes flexible seal A 232 against drill pipe A 220, forming flexible seal and drill pipe seal 362, where flexible seal A 232 engages drill pipe A 220 at drill pipe seal 362. Fluid may travel up jet pump riser joint 300 and through sealing element A 230 only when a pressure of the fluid attempting to go up jet pump riser joint 300 through sealing assembly A 230 may be greater than the pressure of fluid above flexible seal A 232. In an advantageous embodiment, flexible seal A 232 may prevent fluid from traveling up jet pump riser joint 300 when a pressure below may be higher than a pressure above drill pipe seal 362 because drill pipe seal 362 may be maintained by a pressure against drill pipe A 220 exerted by contraction of flexible seal A 232 around drill pipe A 220. Such contraction of flexible seal A 232 around drill pipe A 220 may be known as a positive squeeze.

In an embodiment, such contraction of flexible seal A 232 around drill pipe A 220 may be generated by both external fluid pressure against flexible seal A 232 and also by pressure exerted by material of which flexible seal A 232 may be constructed. The advantageous embodiments recognize and take into account that flexible seal A 232 may be formed in any number of ways that may be known to persons skilled in the art. In an example, flexible seal A 232 may be formed by pouring liquid urethane into a cylinder containing a mold and then removing the mold after the urethane has set in the desired configuration.

The advantageous embodiments recognize and take into account that a number of materials may be selected having characteristics that can withstand pressures in the downhole environment, exposure to hydrocarbons and chemicals used in drilling operations, extreme temperature, friction, and that can also provide an inward radial force from contraction about drill pipe A 220. In an example, flexible seal A 232 may be formed from rubber, thermoplastic rubber, plastic, urethane or any other elastomeric or elastometric material possessing properties suitable for construction of sealing assembly A 230. In an example, flexible seal A 232 may be reinforced by metal fibers or fibers of other materials that may be included in the formation process to provide strength and durability to flexible seal A 232. The metal fibers or fibers of other materials may extend from flexible seal A 232 in order to provide an interface with flexible seal A carrier transition 244. Such metal fibers or fibers of other material may be affixed to flexible seal A carrier transition 244 by a number of methods that may be known to persons skilled in the art. In an example, flexible seal A 232 may be bolted to flexible seal A carrier transition 244.

Sealing assembly A 230 may be sealed between riser joint inner wall 302 and flexible seal A carrier 234 by static seal 248. Referring to FIG. 6 and to FIG. 1, first lug 250 may be affixed to flexible seal A carrier 234 and may remain in position so that when drill pipe A 220 may be withdrawn, running sub 222 of drill pipe A 220 may engage first lug 250 and pull sealing assembly A 230 up to platform 110.

FIG. 7 is an illustration of fluid flow in a jet pump formed by the sealing assembly affixed to the jet pump riser joint and a power fluid introduced into the conduit in accordance with an illustrative embodiment. Referring to FIG. 7, sealing element A 230 may be affixed in sealing assembly A locked position 266 and drill pipe A 220 may move downward through sealing assembly A 230. Drilling fluid flow 354 illustrates the flow downward of drilling fluid from platform 110 to the drill bit. Drilling fluid return flow 352 illustrates drilling fluid that may be brought up from the drill bit through riser string 130 and jet pump riser joint 300. In an embodiment, when the pressure above drill pipe seal 362 may be greater than the pressure below drill pipe seal 362, fluid coming up from the drill bit enters conduit A 314 and may be accelerated by power fluid injected into conduit A 314 through umbilical A 150.

Umbilical nozzle 344 and conduit nozzle section 330 may increase the velocity of power fluid flow 350. In turn, power fluid flow 350 may increase the velocity of drilling fluid return flow 352. The advantageous embodiments recognize and take into account that many known jet pump configurations may be used for injection of power fluid into a drilling fluid return flow.

Figure 10:
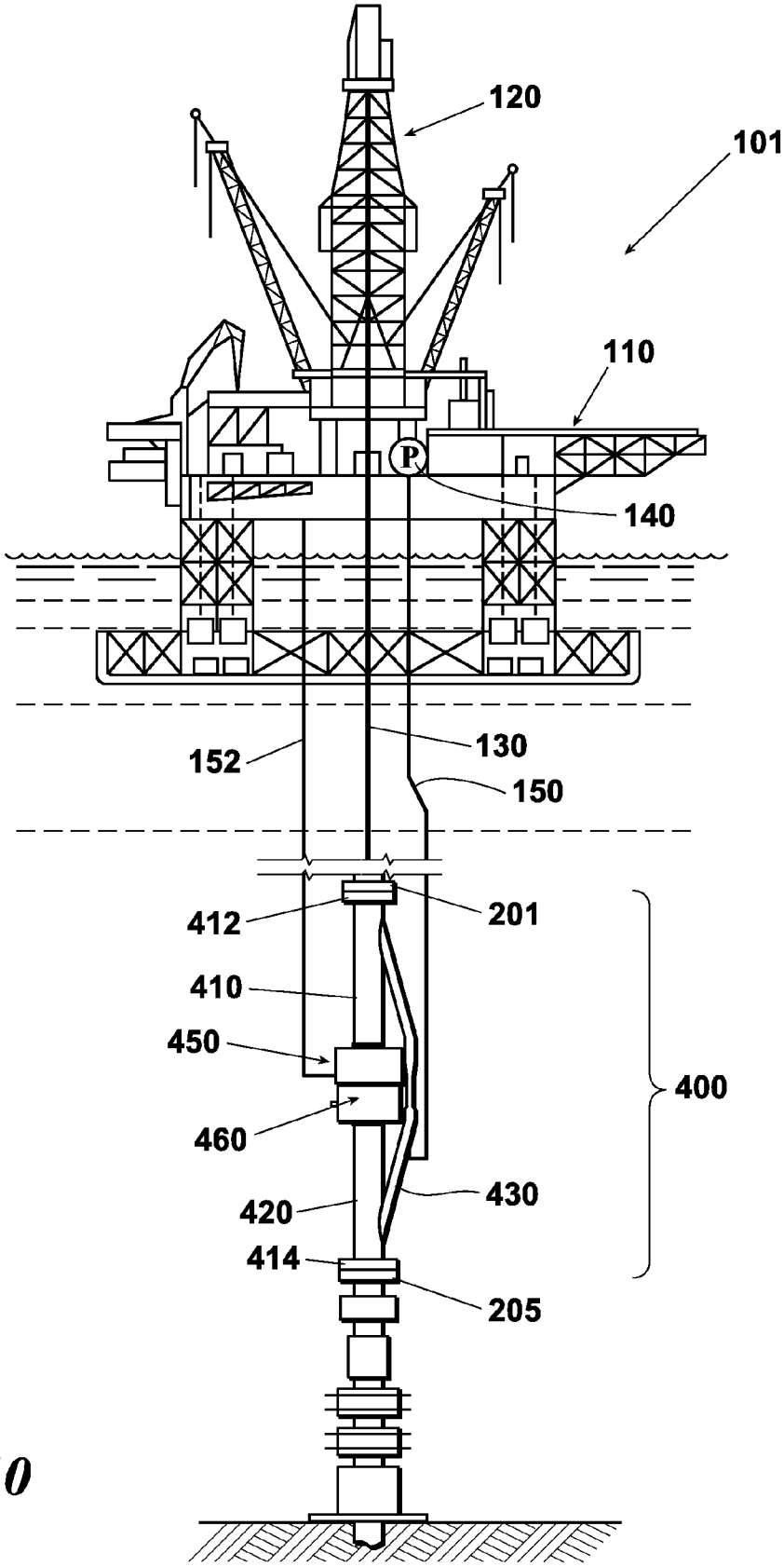
FIG. 10 is an illustration of an alternate drilling system in accordance with an illustrative embodiment.

The advantageous embodiments recognize and take into account that a fixed sealing assembly may be configured to allow passage of a drill bit through a sealing assembly in a jet pump assembly. FIG. 8 through FIG. 10 illustrate such an advantageous embodiment.

FIG. 8 is an illustration of an alternate jet pump assembly in accordance with an advantageous embodiment. Jet pump assembly B 400 comprises riser joint upper section 410, riser joint lower section 420, conduit B 430, sealing assembly B 450, and umbilical B 152. In an example, details of jet pump assembly B 400 are illustrated in an advantageous embodiment in FIG. 9.

FIG. 9 is a detailed illustration of the alternate jet pump assembly of FIG. 8 in accordance with an illustrative embodiment. Sealing assembly B 450 may be affixed to riser joint upper section 410 and to riser joint lower section. Sealing assembly B 450 may comprise container 460, housing 470, and base 472. Container 460 may be rotatably engaged within housing 470 and base 472. Container 460 has upper bearing 534 and lower bearing 536. Flexible seal B 510 may be affixed to container 460 by flexible seal B upper seal 530 and flexible seal B lower seal 532. Container 460 may be sealingly engaged within housing 470 by upper seal 538 and lower seal 540. Flexible seal B 510 may have flexible seal B top 516 and flexible seal B bottom 514. Fluid to control flexible seal B 510 may be inserted into cavity 511 by umbilical B 152 connected to port 556. Fluid may flow through port 556 to first channel 552 and second channel 554. When fluid is inserted into cavity 511 from umbilical B 152, flexible seal B 510 compresses inwardly until flexible seal B inner surface 512 contacts drill pipe B 520. The advantageous embodiments recognize and take into account that flexible seal B 150 may be configured to allow passage of a drill bit through a sealing assembly in a jet pump assembly when flexible seal B 150 is not compressed.

FIG. 10 is an illustration of an alternate drilling system in accordance with an illustrative embodiment. Drilling system B 101 may have jet pump assembly B 400 connected to riser joint lower end flange 201 of riser string 130 at riser joint upper section flange 412 and to blowout preventer stack joint 205 at riser joint lower section flange 414. Umbilical B 152 may extend from drilling platform 110 where it may be controlled by any number of systems known to persons skilled in the art. Referring to FIG. 9 and FIG. 10, umbilical B 152 may provide fluid to insert into cavity 511 to make flexible seal B 510 compress inwardly until flexible seal B inner surface 512 contacts drill pipe B 520.

Figure 11:
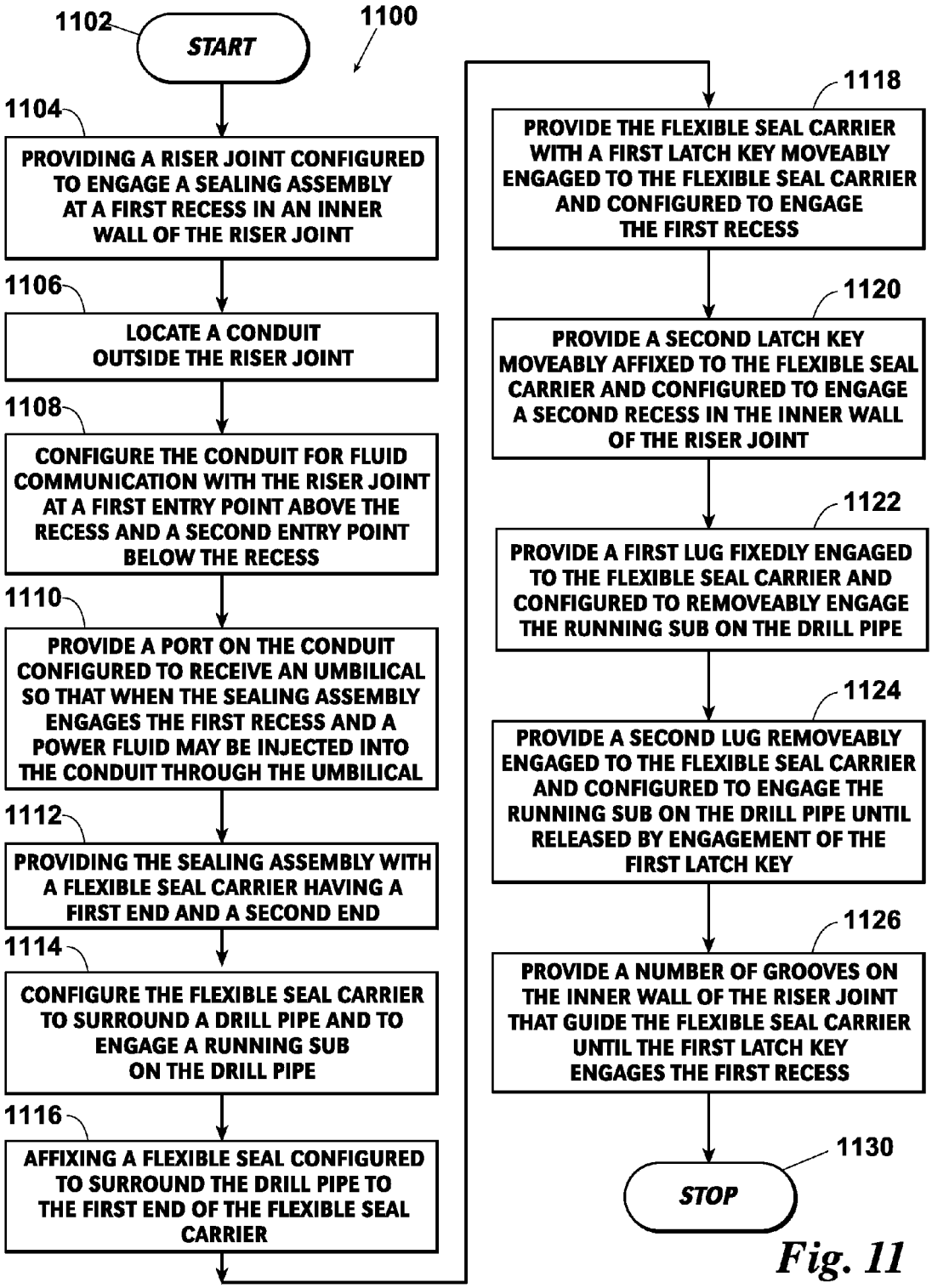
FIG. 11 is an illustration of a flow chart for a process of providing a jet pump assembly in accordance with an illustrative embodiment.

FIG. 11 is an illustration of a flow chart for a process of providing a jet pump assembly in accordance with an illustrative embodiment. Process 1100 starts (operation 1102). Providing a riser joint configured to engage a sealing assembly at a first recess in an inner wall of the riser joint (operation 1104). A conduit may be located outside the riser joint (operation 1106). The conduit may be configured for fluid communication with the riser joint at a first entry point above the recess and a second entry point below the recess (operation 1108). A port may be provided on the conduit configured to receive an umbilical so that when the sealing assembly engages the first recess, and a power fluid may be injected into the conduit through the umbilical (operation 1110). Providing the sealing assembly with a flexible seal carrier having a first end and a second end (operation 1112). The flexible seal carrier may be configured to surround a drill pipe and to engage a running sub on the drill pipe (operation 1114). Affixing a flexible seal configured to surround the drill pipe to the first end of the flexible seal carrier (operation 1116). The flexible seal carrier may be provided with a first latch key moveably engaged to the flexible seal carrier and configured to engage the first recess (operation 1118). A second latch key may be moveably affixed to the flexible seal carrier and configured to engage a second recess in the inner wall of the riser joint (operation 1120). A first lug may be fixedly engaged to the flexible seal carrier and configured to removeably engage the running sub on the drill pipe (operation 1122). A second lug may be removeably engaged to the flexible seal carrier and configured to engage the running sub on the drill pipe until released by engagement of the first latch key (operation 1124). A number of grooves are provided on the inner wall of the riser joint that guide the flexible seal carrier until the first latch key engages the first recess (operation 1126). Process 1100 stops (operation 1130).

Figure 12:
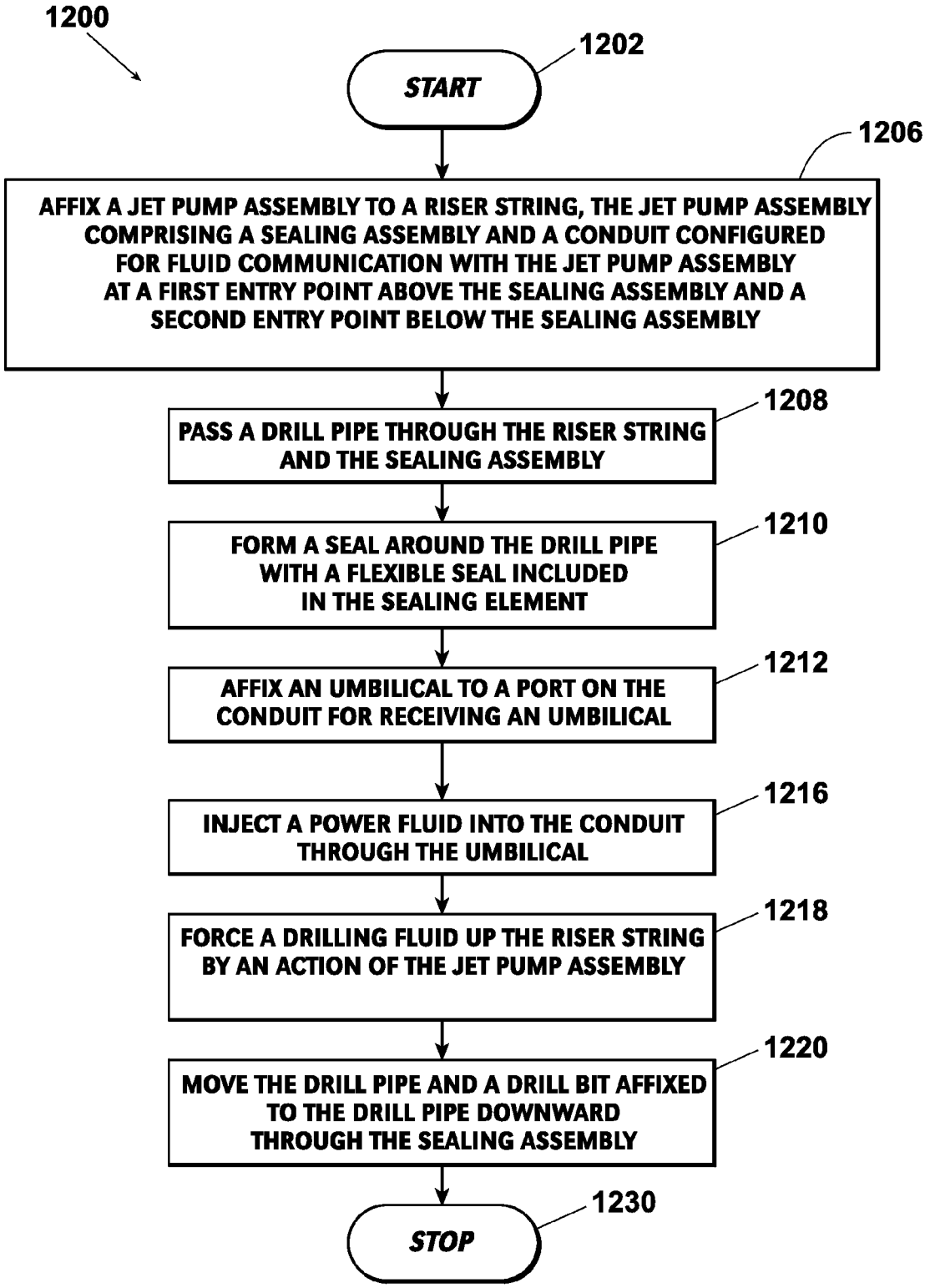
FIG. 12 is an illustration of a flow chart for a process of employing a jet pump assembly in accordance with an illustrative embodiment.

FIG. 12 is an illustration of a flow chart for a process of employing a jet pump assembly in accordance with an illustrative embodiment. Process 1200 starts (operation 1202). A jet pump assembly may be affixed to a riser string, the jet pump assembly comprising a sealing assembly and a conduit configured for fluid communication with the jet pump assembly at a first entry point above the sealing assembly and a second entry point below the sealing assembly (operation 1206). A drill pipe may be passed through the riser string and the sealing element (operation 1208). A seal may be formed around the drill pipe with a flexible seal included in the sealing element (operation 1210). An umbilical may be affixed to a port on the conduit for receiving an umbilical (operation 1212). A power fluid may be injected into the conduit through the umbilical (operation 1216). A drilling fluid may be forced up the riser string by an action of the jet pump assembly (operation 1218). The drill pipe and a drill bit affixed to the drill pipe may be moved downward through the sealing assembly (operation 1220). Process 1200 stops (operation 1230).

In an advantageous embodiment, an apparatus may comprises a riser joint, a conduit located outside the riser joint and configured for fluid communication with the riser joint at a first entry point and at a second entry point, and a port on the conduit receiving an umbilical. A sealing assembly may be engaged in an inner wall of the riser joint. The sealing assembly may further comprise a flexible seal carrier having a first end and a second end and configured to surround a drill pipe and to engage a running sub on the drill pipe. A flexible seal may be affixed to the first end and configured to surround the drill pipe. The drill pipe may pass through the riser joint and the sealing element.

In an embodiment, the flexible seal carrier may further comprise a first latch key moveably engaged to the flexible seal carrier and configured to engage a first recess in an inner wall of the riser joint. The flexible seal may form a seal around the drill string so that and when the power fluid is sent through the port and into the conduit a drilling fluid is forced up the riser joint and up a riser string attached to the riser joint by a jet pump. A second latch key may be moveably affixed to the flexible seal carrier and may be configured to engage a second recess in the inner wall of the riser joint.

In an embodiment, a first lug may be fixedly engaged to the flexible seal carrier and may be configured to removeably engage the running sub on the drill pipe. A second lug may be removeably engaged to the flexible seal carrier and may be configured to engage the running sub on the drill pipe until released by an action of a latch assembly.

In an embodiment, a number of grooves may be configured on the inner wall of the riser joint to guide the flexible seal carrier until the first latch key engages the first recess. A drill bit may be attached to the drill pipe, wherein the sealing assembly remains affixed to the riser joint after the first latch key engages the first recess, and the drill pipe moves downward through the sealing assembly.

In an embodiment, the conduit may comprise a diffuser section and a nozzle section, wherein an umbilical nozzle is positioned approximately within the nozzle section. A pump may be connected to the umbilical, and the umbilical may further comprise an umbilical u-turn section, an umbilical insert section, and an umbilical junction with the port. In an embodiment, a static seal in the flexible seal carrier may engage the inner wall of the riser joint.

In an embodiment, a method may comprise providing a riser joint configured to engage a sealing assembly at a first recess in an inner wall of the riser joint, locating a conduit outside the riser joint, configuring the conduit for fluid communication with the riser joint at a first entry point above the recess and a second entry point below the recess, and providing a port on the conduit configured to receive an umbilical so that when the sealing assembly engages the first recess and a power fluid is injected into the conduit through the umbilical the riser joint and the conduit form a jet pump.

In an embodiment, the method may further comprise providing the sealing assembly with a flexible seal carrier having a first end and a second end, configuring the flexible seal carrier to surround a drill pipe and to engage an running sub on the drill pipe, and configuring a flexible seal to surround the drill pipe and to be affixed to the first end of the flexible seal carrier.

In an embodiment, the method may further comprise providing the flexible seal carrier with a first latch key moveably engaged to the flexible seal carrier and configured to engage the first recess, providing a second latch key moveably affixed to the flexible seal carrier and configured to engage a second recess in the inner wall of the riser joint, providing a first lug fixedly engaged to the flexible seal carrier and configured to removeably engage the running sub on the drill pipe, providing a second lug removeably engaged to the flexible seal carrier and configured to engage the running sub on the drill pipe until released by engagement of the first latch key, and providing a number of grooves on the inner wall of the riser joint that guide the flexible seal carrier until the first latch key engages the first recess.

In an embodiment, a method may comprise affixing a jet pump assembly to a riser string, the jet pump assembly comprising a sealing assembly and a conduit configured for fluid communication with the jet pump assembly at a first entry point above the sealing assembly and a second entry point below the sealing assembly, passing a drill pipe through the riser string and the sealing assembly, forming a seal around the drill pipe with a flexible seal included in the sealing assembly, affixing an umbilical to a port on the conduit for receiving an umbilical, injecting a power fluid into the conduit through the umbilical, and forcing a drilling fluid up the riser string by an action of the jet pump assembly. In an embodiment, the method further comprises moving the drill pipe and a drill bit affixed to the drill pipe downward through sealing assembly.

In an embodiment, a system may comprise a jet pump assembly affixed to a riser string and to a blowout preventer, the jet pump assembly comprising a conduit and a sealing assembly configured to accelerate a drilling fluid's return flow by a power fluid delivered by an umbilical connected to the conduit. In an embodiment, the system may comprise a drilling platform having a pump connected to a first end of the umbilical and to the riser string, wherein the jet pump assembly comprises a conduit and a sealing assembly, wherein a drill pipe and a drill bit affixed to the drill pipe pass through the sealing assembly.

In an embodiment, the system may comprise a port on the conduit configured for receiving a second end of the umbilical. In an embodiment, the sealing assembly may comprise a flexible seal surrounding the drill pipe so that when a power fluid is sent through the port and into the conduit a drilling fluid is forced up the riser string by the jet pump assembly.

The description of the different embodiments of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention the practical application to enable others of ordinary skill in the art to understand the invention for various embodiments with various modifications as are suited to the particular use contemplated.

What is claimed is:

1. An apparatus comprising:

a riser joint;

a conduit located outside the riser joint and configured for fluid communication with the riser joint at a first entry point and at a second entry point; and a port on the conduit configured to receive an umbilical;

wherein the conduit further comprises a nozzle section;

wherein an umbilical nozzle at an end of the umbilical passes through the port to a position approximately within the nozzle section, and a drilling fluid passing through the conduit is accelerated by a power fluid passing through the umbilical and out the umbilical nozzle.

2. The apparatus of claim 1 further comprising:

a sealing assembly engaged in an inner wall of the riser joint.

3. The apparatus of claim 2, wherein the sealing assembly further comprises:

a flexible seal carrier having a first end and a second end and configured to surround a drill pipe and to engage a running sub on the drill pipe; and a flexible seal affixed to the first end and configured to surround the drill pipe.

4. The apparatus of claim 3, wherein the drill pipe passes through the riser joint and the sealing element.

5. The apparatus of claim 3, wherein the flexible seal carrier further comprises:

a first latch key moveably engaged to the flexible seal carrier and configured to engage a first recess in an inner wall of the riser joint.

6. The apparatus of claim 3 further comprising:

wherein the flexible seal forms a seal around the drill string so that when a power fluid is sent through the port and into the conduit a drilling fluid is forced up the riser joint and up a riser string attached to the riser joint by a jet pump.

7. The apparatus of claim 5, further comprising:

a second latch key moveably affixed to the flexible seal carrier and configured to engage a second recess in the inner wall of the riser joint.

8. The apparatus of claim 3, further comprising:

a first lug fixedly engaged to the flexible seal carrier and configured to removeably engage the running sub on the drill pipe;

a second lug removeably engaged to the flexible seal carrier and configured to engage the running sub on the drill pipe until released by an action of a latch assembly.

9. The apparatus of claim 4, further comprising:

a number of grooves on the inner wall of the riser joint that guide the flexible seal carrier until a first latch key engages a first recess.

10. The apparatus of claim 1, wherein the conduit further comprises:

a diffuser section and a mixing section.

11. The apparatus of claim 1, further comprising:

a pump connected to the umbilical;

an umbilical u-turn section;

an umbilical insert section; and an umbilical junction with the port.

12. The apparatus of claim 3, further comprising:

a static seal in the flexible seal carrier engaging the inner wall of the riser joint.

13. A method comprising:

providing a riser joint configured to engage a sealing assembly at a first recess in an inner wall of the riser joint;

locating a conduit outside the riser joint;

configuring the conduit for fluid communication with the riser joint at a first entry point above the recess and a second entry point below the recess; and providing a port on the conduit configured to receive an umbilical so that when the sealing assembly engages the first recess and a power fluid is injected into the conduit through the umbilical the riser joint and the conduit form a jet pump, wherein an umbilical nozzle at an end of the umbilical passes through the port to a position approximately within a nozzle section of the conduit, and a drilling fluid passing through the conduit is accelerated by the power fluid passing through the umbilical and out the umbilical nozzle.

14. The method of claim 13, further comprising:

providing the sealing assembly with a flexible seal carrier having a first end and a second end;

configuring the flexible seal carrier to surround a drill pipe and to engage a running sub on the drill pipe; and configuring a flexible seal to surround the drill pipe and to be affixed to the first end of the flexible seal carrier.

15. The method of claim 14, further comprising:

providing the flexible seal carrier with a first latch key moveably engaged to the flexible seal carrier and configured to engage the first recess;

providing a second latch key moveably affixed to the flexible seal carrier and configured to engage a second recess in the inner wall of the riser joint;

providing a first lug fixedly engaged to the flexible seal carrier and configured to removeably engage the running sub on the drill pipe;

providing a second lug removeably engaged to the flexible seal carrier and configured to engage the running sub on the drill pipe until released by engagement of the first latch key; and providing a number of grooves on the inner wall of the riser joint that guide the flexible seal carrier until the first latch key engages the first recess.

16. A method comprising:

affixing a jet pump assembly to a riser string, the jet pump assembly comprising a sealing assembly and a conduit configured for fluid communication with the jet pump assembly at a first entry point above the sealing assembly and a second entry point below the sealing assembly;

passing a drill pipe through the riser string and the sealing assembly;

forming a seal around the drill pipe with a flexible seal included in the sealing assembly;

affixing an umbilical to a port on the conduit for receiving the umbilical;

injecting a power fluid into the conduit through the umbilical; and forcing a drilling fluid up the riser string by an action of the jet pump assembly, wherein an umbilical nozzle at an end of the umbilical passes through the port to a position approximately within a nozzle section of the conduit, and the drilling fluid passing through the conduit is accelerated by the power fluid passing through the umbilical and out the umbilical nozzle.

17. The method of claim 16, further comprising:

moving the drill pipe and a drill bit affixed to the drill pipe downward through sealing assembly.

18. A system comprising:

a jet pump assembly affixed to a riser string and to a blowout preventer, the jet pump assembly comprising a sealing assembly and a conduit configured to accelerate a drilling fluid by a power fluid delivered by an umbilical connected to the conduit;

wherein the conduit is in fluid communication with the jet pump assembly at a first entry point and a second entry point; and wherein an umbilical nozzle at an end of the umbilical passes through a port to a position approximately within a nozzle section of the conduit, and the drilling fluid passing through the conduit is accelerated by the power fluid passing through the umbilical and out the umbilical nozzle.

19. The system of claim 18, further comprising:

a drilling platform having a pump connected to a first end of the umbilical and to the riser string;

wherein a drill pipe and a drill bit affixed to the drill pipe pass through the sealing assembly.

20. The system of claim 19, further comprising:

a port on the conduit configured for receiving a second end of the umbilical.

21. The system of claim 19, wherein the sealing assembly comprises a flexible seal surrounding the drill pipe so that when the power fluid is sent through a port and into the conduit the drilling fluid is forced up the riser string by the jet pump assembly.

* * * * *